United States Patent [19]

Romick

[11] 4,037,339

[45] July 26, 1977

[54] VISIBLE FILE-CARD SYSTEM

[76] Inventor: Jerome M. Romick, 2008 Zettler Road, Columbus, Ohio 43227

[21] Appl. No.: 719,938

[22] Filed: Sept. 2, 1976

[51] Int. Cl.[2] ..... B42F 15/00

[52] U.S. Cl. ..... 40/104.12

[58] Field of Search ..... 40/104.12, 104.08, 104.13

[56] References Cited

U.S. PATENT DOCUMENTS

| | | | |
|---|---|---|---|
| 1,983,577 | 12/1934 | Straubel | 40/104.18 |
| 2,028,199 | 1/1936 | Fabry | 40/104.12 |
| 2,106,856 | 2/1938 | Rorem | 40/104.12 |

FOREIGN PATENT DOCUMENTS

| | | | |
|---|---|---|---|
| 1,045,259 | 6/1953 | France | 40/104.08 |

*Primary Examiner*—Russell R. Kinsey
*Assistant Examiner*—Wenceslao J. Contreras
*Attorney, Agent, or Firm*—Wm. V. Miller

[57] ABSTRACT

A visible file-card system including a holder and a plurality of cards with cooperating means for pivotally mounting the cards in the holder in superimposed, overlapping, stepped relationship with a portion of the face of each card adjacent its lower edge, visibly exposed. The specific structure for mounting each card on the holder comprises a resilient pivot strip secured to a tab at the upper edge of each card having pivot extensions or pivot lugs on its ends. The holder comprises a back with a longitudinal channel or elongated recess which has flanges at its edges provided with pairs of horizontally spaced opposed pivot openings for receiving the oppositely-projecting pivot lugs of the pivot strips, as the strips are contracted by bending and then allowed to expand to project the pivot lugs into a pair of the opposed pivot openings.

7 Claims, 6 Drawing Figures

VISIBLE FILE-CARD SYSTEM

BACKGROUND OF THE INVENTION

Many different types of visible file-card systems have been provided in the prior art. They are usually of a complicated and, therefore, expensive structure. A well-known type includes a holder or tray with a flat back and channels at its side edges in which spring-pressed pins or wires, attached to the cards, are projected. These cards are, consequently, mounted for sliding displacement along the channels. In addition, there is a tendency for the pins and wires to bend and become inoperative or for the pins to drop out of the channels due to the flexibility of the wires. Also, it is relatively difficult to insert and remove the pins.

BRIEF DESCRIPTION OF THE INVENTION

The present invention provides a simple, inexpensive, yet effective, arrangement for pivotally mounting the cards in a holder in superimposed, overlapping, stepped relationship so that a portion of the face of each is visible adjacent its lower edge. Each card is provided with a tab extension at its upper edge. To this tab, is secured a resilient pivot strip, the strip being attached at laterally spaced points, by suitable fasteners, so that a finger can be inserted between the strip and the tab to flex the strip. At its opposite ends, the pivot strip is provided with laterally-extending pivot lugs. The holder includes a back which has a recess formed therein that is of substantial extent. The opposed side walls of this recess are provided with spaced pairs of aligned pivot openings. To mount each card on the holder, the pivot strip thereon is flexed to contract the strip is inserted in the recess opposite the pivot openings of a pair, and then the strip is allowed to expand to project its pivot lugs into the openings.

Because of the recess, the pivot strips need not be very long and they will not tend to accidentally bend and withdraw the pivot lugs thereof. Also, the cards will be held in a fixed pivotal position along the holder. Furthermore, because of the recess and the fact that the tabs and pivot strips will be disposed therein below the main surface of the back, there will not be as great a build-up of the cards on the back. Any card may be removed, merely by bending the pivot strip so as to withdraw the pivot lugs thereof from the cooperating pivot openings.

BRIEF DESCRIPTION OF THE DRAWINGS

The best mode contemplated in carrying out this invention is illustrated in the accompanying drawings in which.

DETAILED DESCRIPTION OF THE INVENTION

Figure 5:
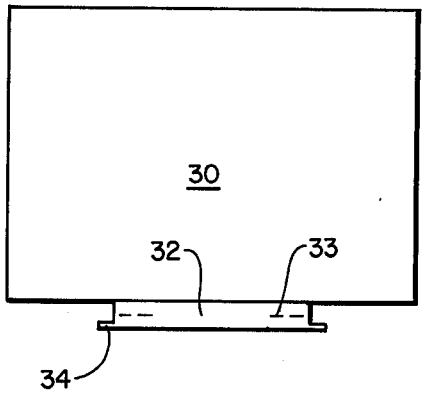
FIG. 5 is a plan view of the back of the flat card.
Figure 6:
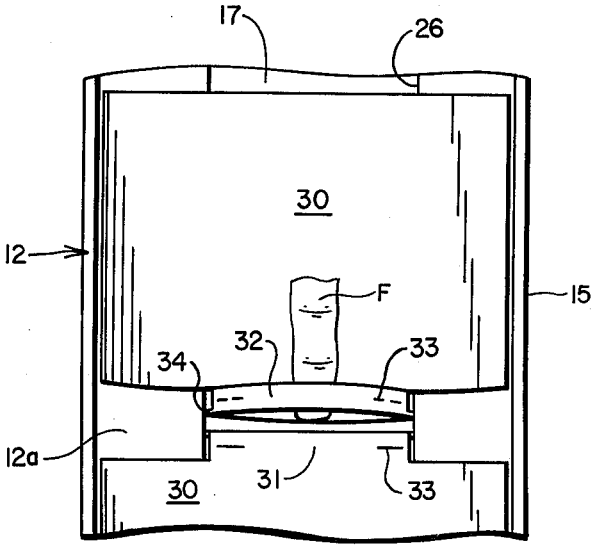
FIG. 6 is a similar view but showing the card in the holder with a finger inserted between the pivot strip and tab of the card to bend the strip and contract it.

With reference to the drawings, in FIGS. 1 to 4 and 6 the holder for the cards is shown and in FIG. 5 the card itself is shown out of the holder. The holder is preferably of a suitable plastic. The cards are preferably of cardboard but could be of a plastic or other suitable material.

The holder is rectangular and tray-like in overall form and is shown consisting mainly of three parts, namely, a backing or base panel 11 of tray form, a front card-receiving panel 12 of tray form which slips over the panel 11 and a hinged flat flexible cover 13 which is pivoted to the one end of the tray panel 12.

The panel 11 has an upstanding peripheral flange 14 extending completely therearound and a flat back **11*a*. The panel 12 has a peripheral flange 15 of inverted U-cross-section extending completely around and depending from a flat back 12*a* which slips over the upstanding flange 14 and may be secured thereto by transverse fasteners 16. In addition, the back 12*a* is provided with a recess or channel 17, the back of which will contact the back 11*a*** and may be bonded thereto.

The one end of the card-receiving tray panel 12 is provided with an upstanding ledge 18 which is formed by a continuation of the end part of the flange 15 and an inwardly inclined wall 19. Spaced forwardly of the lower extremity of this inclined wall and on the opposed side portions of the flange 15, are upstanding lugs 20 which have pivot openings or sockets 21 opening inwardly therefrom. These sockets are adapted to receive the opposite ends of a pivot rod 22 which is welded within a curled lip 23 at the top edge of the cover 13. At its upper and outer corners, the cover 13 is provided with notches 24 so as not to interfere with the lugs 20 when it is mounted on the panel 12. The cover is a flexible panel and has depending side flanges 25 which, when the cover is swung into closed position, will extend downwardly over the side portions of the flange 15. When the cover 13 is swung upwardly and backwardly, by the tab **13*a*, located at the center of the bottom edge of the cover, it will rest against the inclined wall 19 which will serve as a stop. Since the cover, and the rod 22 carried thereby, are flexible, it may be bent to withdraw the ends of the rod from the sockets 21, if the cover is to be removed. To replace it, the cover is flexed and the ends of the rod are positioned within the lugs 20 in alignment with the sockets 21** and the cover is then allowed to return to its planar form which will project the ends of the rods into the sockets.

Figure 1:
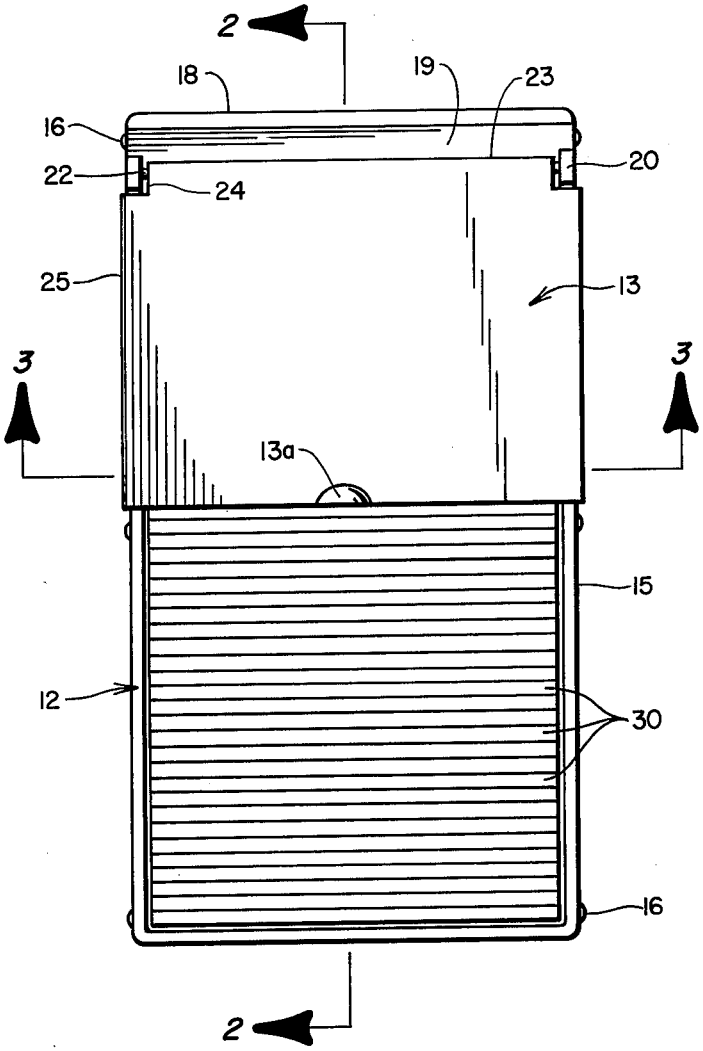
FIG. 1 is a plan view of the card holder filled with cards retained therein according to this invention.
Figure 2:
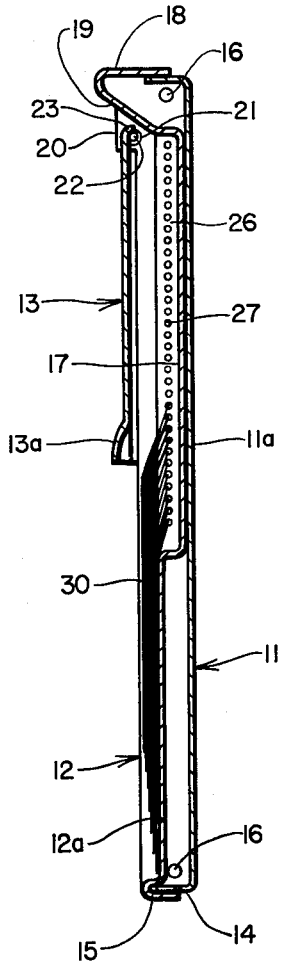
FIG. 2 is a longitudinal sectional view taken along line 2—2 of FIG. 1 with a portion of the cards removed.
Figure 3:
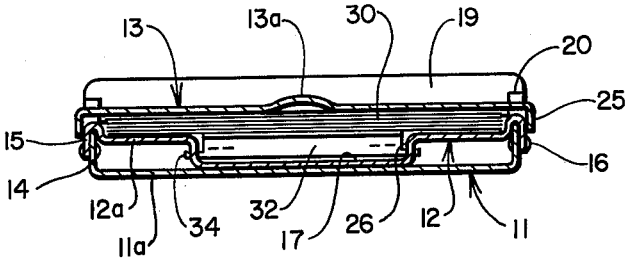
FIG. 3 is a transverse sectional view taken along line 3—3 of FIG. 1.
Figure 4:
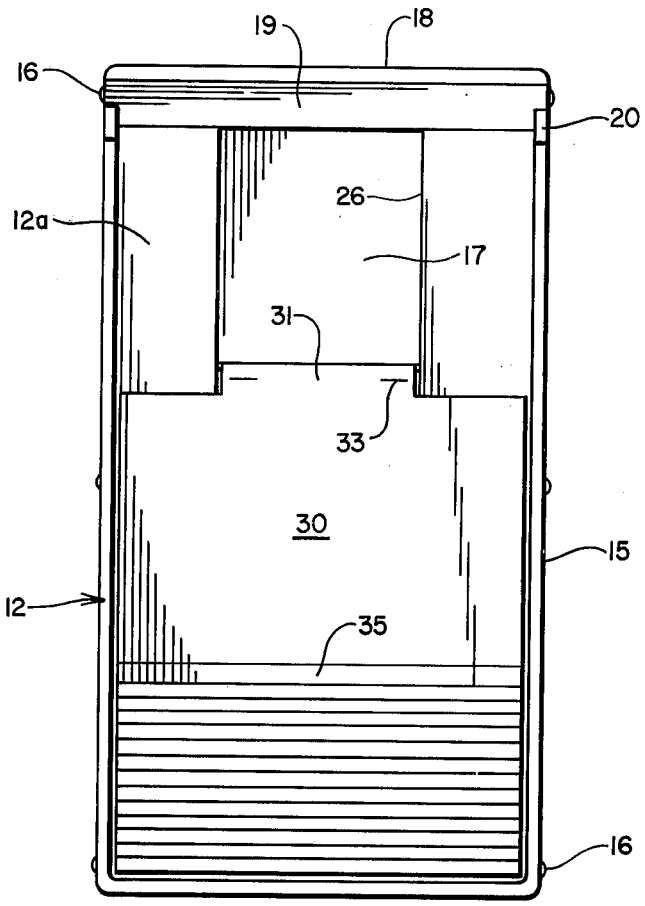
FIG. 4 is a plan view of the tray of the holder with the cover removed and showing it only partly filled with cards.

The recess or channel 17 is an important feature of the invention and, as indicated above, is formed in the back **12*a* of the tray-like panel 12. It extends from the end thereof where the cover 13 is hinged, the greater part of the length thereof, to a point located beyond the midpoint sufficiently to position the lower edge of the lowermost card adjacent the end portion of the flange 15, as indicated in FIG. 2. So-forming this recess 17 provides longitudinally-extending walls or flanges 26 of substantial depth. These flanges are disposed parallel with each other and are provided with longitudinally spaced inwardly-opening sockets or openings 27. It will be noted, that the openings in the opposed flanges 26 are in alignment with each other. Thus, there are provided at spaced intervals along the recess 17, pairs of opposed pivot-receiving openings or sockets 27.**

As indicated before, the cards may be of suitable flexible material such as paper or plastic. They are indicated generally by the numeral 30 and are shown in detail best in FIGS. 5 and 6.

Each card is shown as being of rectangular form with an elongated tab 31 located midway along its upper edge. Secured to the back surface of the tab 31 and extending completely across it, is a clip strip 32 of suitable resilient material, preferably plastic. The clip strip is secured to the tab, only adjacent its ends, by simple fasteners. such as staples 33. It will be noted that the clip strip 32 is substantially co-extensive with the tab 31 but has, at its opposite ends and upper edge, laterally-projecting narrow pivot lugs 34 which are adapted to be inserted into the sockets 27 of the card holder.

It is important to secure the clip strips 32 only at their ends so that there is an unsecured section therebetween. Therefore, as will be apparent from FIG. 6, a finger F can be inserted between the flexible strip 32 and tab 31 so as to bend the clip to decrease its overall length. Originally its main part, without the lugs 34, is of slightly less length than the width of the recess 17 or spacing of the flanges 26 thereof.

When the clip is so bent, its overall length, including the pivot lugs 34, is reduced to permit insertion of the card tab 31 and the pivot strip 32, carried thereby, into the channel recess 17. The lugs 34 can be aligned with a pair of the opposed inwardly-opening sockets 27 and if the finger is now withdrawn, the strip will straighten out to project the lugs 34 into the sockets 27.

Each card may carry on its lower edge an elongated pocket 35, formed of transparent plastic, for recieving labels in the form of printed or typewritten strips.

From the above, it will be apparent that the cards 30 can be readily mounted on the holder or be removed therefrom. To mount each card, it is merely necessary to insert the finger F between the pivot strip 32, carried thereby, to retract the pivot lugs 34, insert the strip in the recess or channel 17, and then withdraw the finger F to permit expansion of the strip to project the pivot lugs 34 into the aligned sockets 27. The card 30 will now be pivotally secured in a selected position fixed longitudinally of the channel recess 17. Because the pivot strips 32 need only be as long as the width of the recess 17 they will not be so flexible as to tend to accidentally bend and retract the pivot lugs 34 from the sockets 27. However, the lugs are of such resiliency that they can be retracted by inserting the finger F between the pivot strips and the card tab so as to permit removal when desired. There are no springs, wires or other parts tending to become inoperative, the only mounting part being the strip 32 secured to the card tab 31 by ordinary staples 33. Thus, the means for pivotally mounting the cards at fixed locations are extremely simple and inexpensive, yet effective, and will last indefinitely under repeated use. Because the tabs 31 and the strips 32 are positioned in the recess 17, undue build-up on the back 12a will be avoided, but the bodies of the cards will rest solidly on the back, on the flat support surfaces at each side of the recess, which will facilitate making entries thereon.

Having thus described this invention, what is claimed is:

1. A visible file-card assembly comprising a holder including a back panel with a longitudinally-extending recess formed therein to provide parallel spaced longitudinally-extending depending flanges of substantial depth and longitudinally-extending card-support surfaces at each side thereof, said flanges having pairs of aligned inwardly-opening pivot socket openings formed therein at longitudinally-spaced intervals; and cards adapted to be mounted on the holder, said cards being of flexible material, a tab projecting upwardly from the upper edge of each card and of slightly less lateral extent than the spacing of said recess flanges so that it can be inserted in the recess between the flanges and so located laterally on the card as to provide laterally-disposed card surfaces which will rest on the flat card support surfaces at each side of the recess, a resilient pivot strip secured to the tab at laterally spaced points so there is an unsecured portion therebetween to permit insertion of the finger between the strip and tab for flexing, said pivot strip having pivtos projecting from the opposed ends thereof beyond the respective end of the tab, flexing and bowing of the pivot strip by insertion of the finger between it and the tab contracting the strip to shorten the overall length of the strip with its pivots to permit insertion of the strip on the tab into the holder recess to align the pivots therof with a pair of said pivot socket openings and withdrawal of the finger permitting extension of the strip so that the pivots thereof will project into the opposed openings of the pair to pivot the card to the holder and permit it to rest on said card support surface at each side of the recess and removal of the card by inserting the finger to flex and bow the strip to withdraw the pivots from said socket openings.

2. A visible file-card assembly according to claim 1 in which the pivot strip is a flat strip of resilient plastic material and consists of a body of the same length as the lateral extent of the tab and has integral lugs projecting from the ends thereof, said strip being positioned flat against the tab with its body co-extensive with the tab and with the lugs projecting in opposite directions beyond the opposed ends of the tab so as to provide the pivots, and fasteners only at the corresponding ends of the tab and strip body to fasten the strip body to the tab.

3. A visible file-card assembly according to calim 2 in which the tab is located midway of the sides of the card on its upper edge, and the recess in the holder is located midway of the side edges of the back panel.

4. A visible file-card assembly according to claim 3 in which the holder is of tray-like form with the back plate and with upstanding flanges at the side edges of the plate, the recess being located midway of the flanges in the back plate and extending from a point adjacent the top end of the tray to point spaced upwardly from the bottom end, and a cover hinged to the top end.

5. A visible file-card assembly according to claim 4 in which the cover is resilient and has hinge pins projecting from its sides, a pair of lugs at the respective side flanges adjacent the top end of the tray having inwardly-opening sockets for receiving said hinge pins, and an upstanding ledge at the top of the tray end extending transversely across it, said ledge having an inclined forward surface which serves as a stop for said cover when it is swung upwardly about said hinge pins.

6. A file card assembly for mounting in a visible holder comprising a flat flexible panel having a tab on its upper edge midway of the sides thereof and of selected lateral extent, a flat resilient strip consisting of a body of the same lateral extent as the lateral extent of the tab having pivot lugs projecting in opposite directions from the ends of the body, said strip being positioned flat against the tab with its body coextensive with the tab and with the pivot lugs projecting in opposite directions beyond the opposed ends of the tab so as to provide projecting pivots, and fasteners at the corresponding ends only of the tab and strip body to fasten the strip body to the tab.

7. A file card according to claim 6 made of cardboard with the tab integral therewith, said pivot strip being of resilient plastic material with the pivots being integral lugs projecting from the body thereof, said fasteners being staples passed through the strip body and tabs only at the corresponding ends thereof.

* * * * *